US008950389B2

(12) United States Patent
Horstkoetter et al.

(10) Patent No.: US 8,950,389 B2
(45) Date of Patent: Feb. 10, 2015

(54) OVEN WITH A CHAMBER AND A CROSS-FLOW BLOWER

(75) Inventors: Andreas Horstkoetter, Herzebrock-Clarholz (DE); August Oberroehrmann, Guetersloh (DE); Helmut Rothenbacher, Guetersloh (DE); Ulrich Sillmen, Guetersloh (DE)

(73) Assignee: Miele & Cie. KG, Guetersloh (DE)

( * ) Notice: Subject to any disclaimer, the term of this patent is extended or adjusted under 35 U.S.C. 154(b) by 1797 days.

(21) Appl. No.: 11/867,902

(22) Filed: Oct. 5, 2007

(65) Prior Publication Data

US 2008/0083400 A1 Apr. 10, 2008

(30) Foreign Application Priority Data

Oct. 5, 2006 (DE) ..... 10 2006 047 587

(51) Int. Cl.
*A21B 3/00* (2006.01)
*F24C 15/20* (2006.01)

(52) U.S. Cl.
CPC ..... *F24C 15/2007* (2013.01)
USPC ..... 126/21 R; 126/273 R; 126/19 R; 126/21 A

(58) Field of Classification Search
USPC ..... 126/21 R, 21 A, 19 R, 273 R; 219/757, 219/681, 400
See application file for complete search history.

(56) References Cited

U.S. PATENT DOCUMENTS 5,500,508 A * 3/1996 Gerl ..... 219/400
5,918,589 A * 7/1999 Valle et al. ..... 126/193

FOREIGN PATENT DOCUMENTS

| | | | |
|---|---|---|---|
| DE | 2656565 | | 6/1978 |
| DE | 3741975 | | 6/1989 |
| DE | 4407702 | A1 | 11/1995 |
| DE | 19509569 | A1 | 9/1996 |
| EP | 0663568 | A1 | 7/1995 |
| EP | 0732549 | A2 | 9/1996 |

OTHER PUBLICATIONS

European Search Report for EP 07 01 8245 dated Nov. 15, 2010.

* cited by examiner

*Primary Examiner* — Alfred Basichas
(74) *Attorney, Agent, or Firm* — Leydig, Voit & Mayer, Ltd.

(57) ABSTRACT

An oven with a baking chamber includes a crossflow fan with a connected cooling air duct configured to generate a cooling air stream that is exhausted to outside the oven. A vapor exhaust duct opening is included into the cooling air duct so as to exhaust vapors from the baking chamber therethrough. The vapor exhaust duct has an opening area disposed in an immediate vicinity of an exhaust area of the crossflow fan where a suction capacity for the vapors from the vapor exhaust duct is generated at a minimum rotational speed of the fan propeller.

8 Claims, 4 Drawing Sheets

OVEN WITH A CHAMBER AND A CROSS-FLOW BLOWER

Priority is claimed to German patent application DE 10 2006 047 587.9, filed Oct. 5, 2006, and which is hereby incorporated by reference herein.

The invention relates to an oven with a baking chamber, whereby a crossflow fan with a connected cooling air duct generates a cooling air stream that is exhausted to the outside, and whereby a vapor exhaust duct opens up into the cooling air duct so that the vapors can be exhausted from the baking chamber through said vapor exhaust duct.

BACKGROUND

In known ovens, vapors are exhausted via a cooling air duct located above the baking chamber and they are then fed to the outside. Therefore, various embodiments are known in order to make it possible to exhaust vapors via the cooling air duct.

Thus, for example, German publication DE 26 56 565 describes an oven in which the place where the vapor exhaust duct opens up is near the air outlet opening of an exhaust air duct that is configured as a cooling air collector. In order to bring about a suction of the vapors an air baffle is arranged in the cooling air collector so that, in this manner, the cooling air flow, which moves at a relatively high speed, can be admixed with the vapors in the manner of the injector principle.

Another embodiment is described in German publication DE 37 41 975, whereby this is a device for controlling a steam-operated cooking appliance having a cooling air stream that is generated in the pressure duct by a fan. For this purpose, the fan is provided with a return line leading from the pressure duct to the suction side of the fan, and said return line is connected to the cooking chamber via a closable steam outlet opening. Thus, with this embodiment, especially the vapor exhaust can be regulated.

With the known devices, so-called crossflow fans are used for exhausting vapors. They have a poor efficiency, but they are relatively quiet and they fulfill the requirement for a large air volume throughput for purposes of cooling and exhausting vapors. However, due to the structural design, the adaptation to the baking chamber is complex and, as a rule, calls for additional parts. Complex systems as described are generally known. A disadvantage of the models based on the injector principle is that, for example, a constriction has to be created in the exhaust air duct, for example, by means of air baffles, in order to achieve the injector effect.

The other above-mentioned coupling, in which an extended exhaust air connecting piece was placed in a suitable form near the roller of the crossflow fan, has the drawback that the vapors have to be carried via an additional line to the top of the crossflow fan. Here, the concrete realization of the exhaust air connecting piece is very complex, and moreover, water vapor in the connecting piece has to be taken into consideration at temperatures below 100° C.

SUMMARY

Thus, it is an aspect of the present invention to provide an oven with a baking chamber in such a way that the connection of a vapor exhaust duct is simplified in terms of its structure and design.

In an embodiment, the present invention provides an oven with a baking chamber that includes a crossflow fan with a connected cooling air duct configured to generate a cooling air stream that is exhausted to outside the oven. A vapor exhaust duct opening is included into the cooling air duct so as to exhaust vapors from the baking chamber therethrough. The vapor exhaust duct has an opening area disposed in an immediate vicinity of an exhaust area of the crossflow fan where a suction capacity for the vapors from the vapor exhaust duct is generated at a minimum rotational speed of the fan propeller.

BRIEF DESCRIPTION OF THE DRAWINGS

An embodiment of the present invention is depicted schematically in the drawings and will be explained in greater detail below. The following are shown.

DETAILED DESCRIPTION

Advantages that can be achieved with the invention lie include the fact that the connection of a vapor exhaust duct is greatly simplified in terms of its structure and design. In the front area, close to the exhaust opening, the crossflow fan draws in a great deal of additional air from the outside and feeds it into the cooling air duct. This is where an opening in the housing of the crossflow fan is provided, so that the baking chamber located below the fan is simply and directly coupled by means of the vapor exhaust duct.

With these design measures, a simple coupling of the crossflow fan to the vapor exhaust system can be achieved. An advantage of a solution according to the invention lies in the fact that the exhaust air duct and the exhaust air connecting piece/mixing box can be reduced to a minimum here. In a minimal form, the entire vapor exhaust system consists only of the modified crossflow fan and the two openings below it in the assembly plate and in the baking chamber in order to achieve the flow-conducting coupling of the baking chamber by means of the vapor exhaust duct thus formed. The exhaust air duct can be dispensed with if the exhaust area of the crossflow fan is arranged in the immediate vicinity of the exhaust opening of the oven housing.

According to the invention, the opening area of the vapor exhaust duct is arranged in the immediate vicinity of the exhaust area of the crossflow fan at which the requisite suction capacity for the vapors from the vapor exhaust duct is generated at a minimum rotational speed of the fan propeller. The opening area is arranged downstream from the fan propeller in the direction of flow of the cooling air stream. The opening area is arranged relative to the crossflow fan in such a way that the suction capacity is the greatest at the maximum rotational speed of the crossflow fan. Here, in an advantageous manner, an exhaust air duct is connected to the exhaust area of the crossflow fan in order to carry away the mixed air stream consisting of cooling air and vapors. The crossflow fan with the suction opening for the opening area of the vapor exhaust duct is arranged here on an assembly part, whereby the assembly part has an opening for this purpose.

Figure 1:
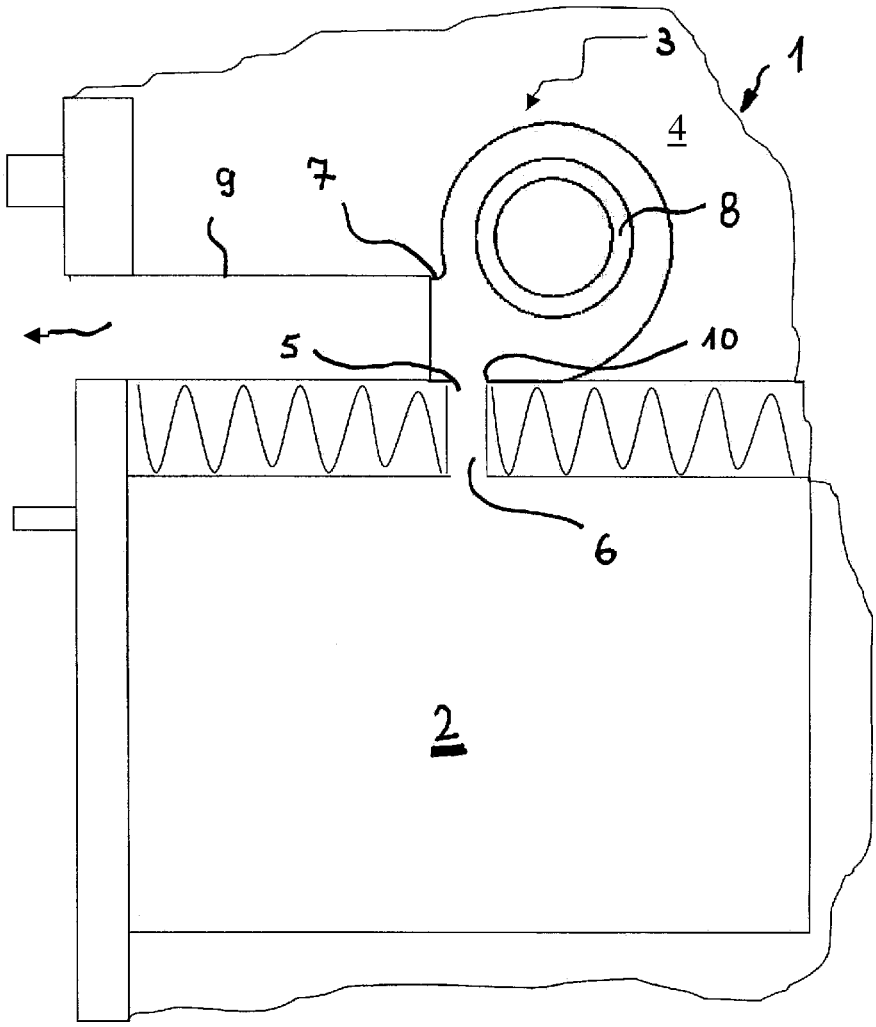
FIG. 1 a partial cutaway side view of an oven with a baking chamber above which a crossflow fan is arranged.

FIG. 1 shows an oven 1 with a baking chamber 2, whereby, above the baking chamber 2, a crossflow fan 3 with a connected cooling air duct 4 generates a cooling air stream, which is carried away to the outside. As can be seen in FIG. 1, the opening area 5 of a vapor exhaust duct 6 is arranged here in the immediate vicinity of the exhaust area 7 of the crossflow fan 3. Especially in order to effectively exhaust the vapors, a suction capacity for the vapors from the vapor exhaust duct 6 is established at an empirically determined minimum rotational speed of the fan propeller 8. For this purpose, as can be seen in the figure, the opening area 5 in the flow direction of the cooling air stream is arranged downstream from the fan propeller 8, which is only sketched here. The opening area 5 is arranged relative to the crossflow fan 3 in such a way that the suction capacity is greatest at the maximum rotational speed of the crossflow fan 3. Thus, like in the present embodiment, an exhaust air duct 9 for carrying away the mixed air stream consisting of cooling air and vapors can be connected to the exhaust area 7 of the crossflow fan 3.

Figure 3:
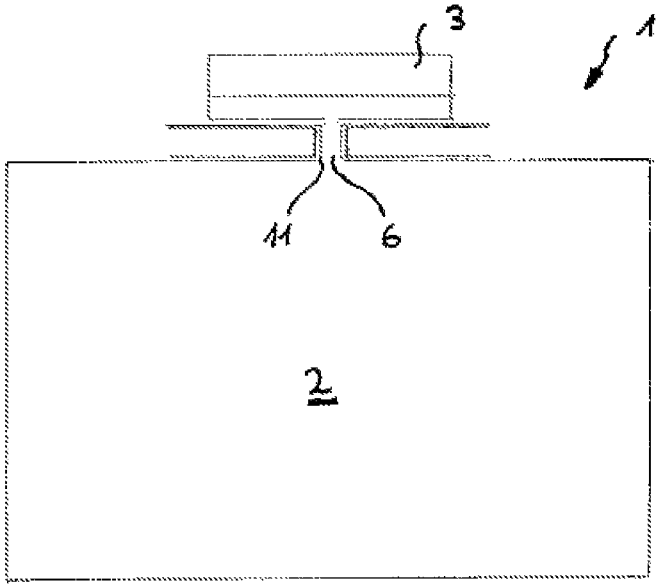
FIG. 3 another view according to FIG. 1, whereby here the crossflow fan is depicted in a rear view and FIG. 4 another graphic depiction of the total pressure as a function of the rotational speed of the crossflow fan and of the position of the measuring point.

For the assembly, the crossflow fan 3 with a suction opening 10 for the opening area 5 of the vapor exhaust duct 6 is arranged on an assembly part 11, whereby, for this purpose, the assembly part 11 has a opening configured so as to correspond to the suction opening 10. The functional effect of the assembly part 11 can be seen more clearly in FIG. 3. The crossflow fan 3 is attached by means of the assembly part 11 to the rest of the oven 1 in a simple manner.

Figure 2:
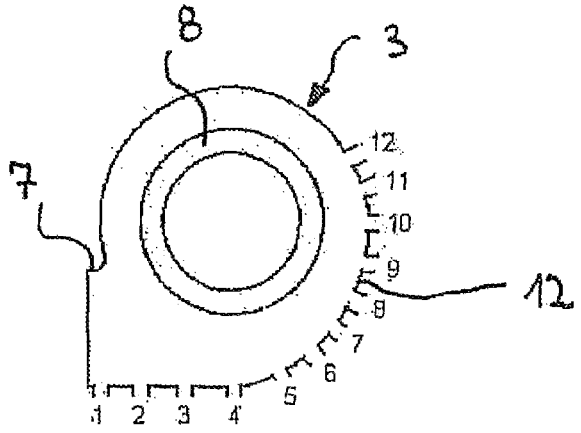
FIG. 2 an isolated depiction of the crossflow fan according to FIG. 1, whereby measuring points are marked along the circumferential surface of the housing; in order to depict the suction-pressure behavior of the crossflow fan above the circumferential surface, the course of the total pressure as a function of the position of the measuring point is plotted in the graph shown below the drawing.
Figure 2:
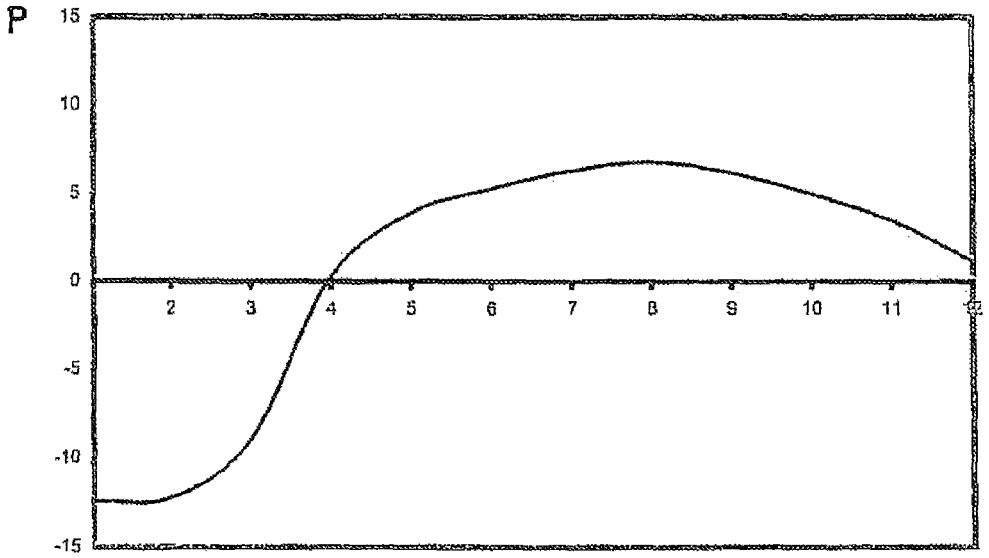

In order to explain the inventive idea, FIG. 2 shows the crossflow fan 3 in an isolated depiction. Here, the circumferential surface area 12 of the crossflow fan 3 is provided with numbers "1" to "12". These numbers indicate the pressure measuring points of the performed tests and, in the diagram below the figure, they are likewise plotted from "1" to "12" on the X-axis. The Y-axis indicates the pressure data, that is to say, the overpressure and the negative pressure, that occur at maximum rotational speeds of the crossflow fan 3. Thus, it can be clearly seen that the area from "1" to "4" of the exhaust area 7 represents a suction zone. The opening area 5 of the vapor exhaust duct 6 is located precisely in this area, namely, in the immediate vicinity of the exhaust area 7 of the crossflow fan 3, that is to say, in the area between the first and third measuring points from the experiment. Thus, a simple connection of the vapor exhaust duct 6—which ultimately only has to have one opening to the baking chamber 2—to the crossflow fan 3 can be created. This eliminates the need for complex constructions.

Figure 4:
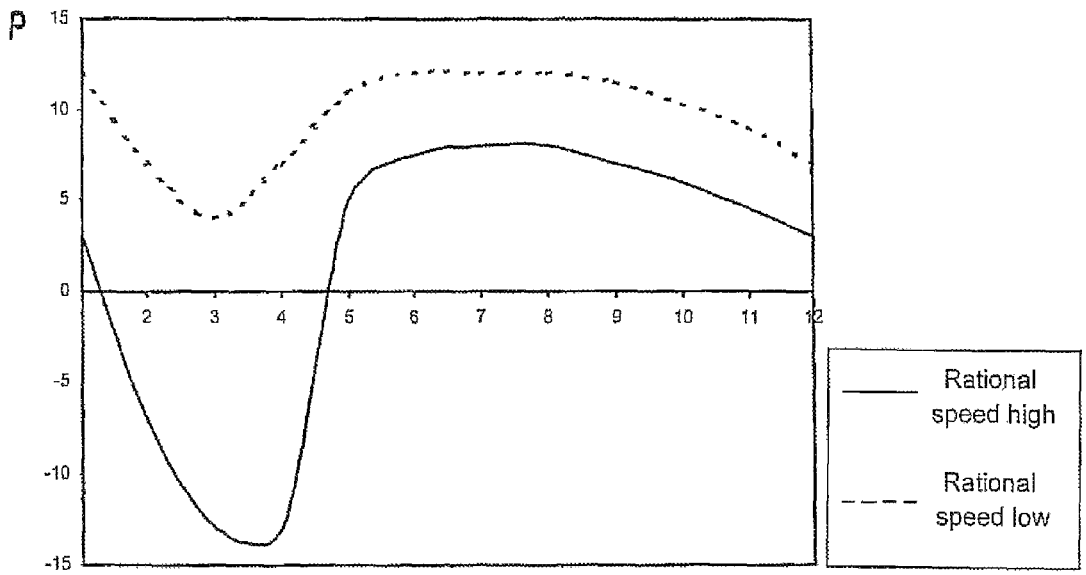

FIG. 4 shows another graph, whereby the measuring points "1" to "12" of the circumferential surface 12 of the crossflow fan 3 are likewise plotted on the X-axis of the graph, whereby the solid line represents the suction-pressure behavior of the crossflow fan 3 when it is running at its maximum rotational speed. The graph clearly shows a suction capacity of the crossflow fan 3 in the area between the first and fourth measuring points. If the fan speed is reduced, which is represented by means of the broken line, then a pressure area also appears in the area of the first to fourth measuring points.

This is why it is important that, in order to exhaust vapors, that is to say, during a baking process, a minimum rotational speed of the fan propeller 8 be ensured so that at least the negative pressure needed for the exhausting procedure is present in the opening area 5 of the vapor exhaust duct 6. This minimum rotational speed varies markedly as a function of the type of oven used and consequently has to be determined empirically.

The present invention is not limited to the particular embodiments described herein and can be modified without departing from the scope set forth in the following claims.

What is claimed is:

1. An oven comprising:

a baking chamber, a crossflow fan with a connected cooling air duct configured to generate a cooling air stream that is exhausted to the outside, and a vapor exhaust duct opening into the cooling air duct at an opening area of the vapor exhaust duct so as to exhaust vapors from the baking chamber therethrough, the opening area of the vapor exhaust duct being disposed downstream of a fan propeller of the crossflow fan in a direction of flow of the cooling air stream such that the exhaust vapors join the cooling air stream downstream of the fan propeller, and being disposed in an immediate vicinity of an outlet of the crossflow fan where a suction capacity for the vapors from the vapor exhaust duct is generated at a minimum rotational speed of the fan propeller.

2. The oven as recited in claim 1, further comprising an assembly part including an opening, and wherein the crossflow fan includes a suction opening for the opening area of the vapor exhaust duct, the crossflow fan is disposed on the assembly part, and the opening of the assembly part corresponds to the suction opening of the crossflow fan.

3. The oven as recited in claim 1, further comprising an exhaust air duct connected to the exhaust area of the crossflow fan so as to carry away a mixed air stream of the cooling air and the vapors.

4. The oven as recited in claim 3, further comprising an assembly part including an opening, and wherein the crossflow fan includes a suction opening for the opening area of the vapor exhaust duct, the crossflow fan is disposed on the assembly part, and the opening of the assembly part corresponds to the suction opening of the crossflow fan.

5. The oven as recited in claim 1, wherein the opening area is disposed relative to the crossflow fan so that the suction capacity is greatest at a maximum rotational speed of the crossflow fan.

6. The oven as recited in claim 5, further comprising an assembly part including an opening, and wherein the crossflow fan includes a suction opening for the opening area of the vapor exhaust duct, the crossflow fan is disposed on the assembly part, and the opening of the assembly part corresponds to the suction opening of the crossflow fan.

7. The oven as recited in claim 5, further comprising an exhaust air duct connected to the exhaust area of the crossflow fan so as to carry away a mixed air stream of the cooling air and the vapors.

8. The oven as recited in claim 7, further comprising an assembly part including an opening, and wherein the crossflow fan includes a suction opening for the opening area of the vapor exhaust duct, the crossflow fan is disposed on the assembly part, and the opening of the assembly part corresponds to the suction opening of the crossflow fan.

* * * * *